United States Patent [19]

Grossman

[11] 4,125,430

[45] Nov. 14, 1978

[54] AIR DECOMPACTION OF PAPER WEBS

[75] Inventor: Stephen R. Grossman, Maple Shade, N.J.

[73] Assignee: Scott Paper Company, Philadelphia, Pa.

[21] Appl. No.: 789,809

[22] Filed: Apr. 22, 1977

[51] Int. Cl.[2] ..... D21F 11/00

[52] U.S. Cl. ..... 162/207; 34/33; 162/135; 427/326

[58] Field of Search ..... 162/205–207, 162/115, 290, 297, 307, 135; 28/103–105; 34/33, 156, 160, 162; 68/5 D; 19/161 R, 161 P; 427/324, 326

[56] References Cited

U.S. PATENT DOCUMENTS

| | | | |
|---|---|---|---|
| 1,472,572 | 10/1923 | Tompkins | 162/206 |
| 2,730,933 | 1/1956 | Reynolds | 162/307 |
| 3,301,746 | 1/1967 | Sanford et al. | 162/206 |
| 3,490,103 | 1/1970 | Asaka et al. | 19/161 P |
| 3,556,931 | 1/1971 | Champaigne | 162/207 |

OTHER PUBLICATIONS

Brochure entitled "AFP" Honshu Paper Co., Ltd.

*Primary Examiner*—S. Leon Bashore
*Assistant Examiner*—Peter Chin
*Attorney, Agent, or Firm*—Joseph H. Yamaoka; William J. Foley

[57] ABSTRACT

A method of and apparatus for reducing the density and increasing the bulk of a fibrous web having an initial basis weight between 20 and 60 pounds per ream and an initial nondirectional breaking length between 50 and 500 meters.

The web is loosely placed between a pair of wire screens. The screens and the web are then transported past a nozzle assembly that impinges a gaseous medium onto the surface of the web with sufficient velocity so that the fibrous web is decompacted throughout the entire thickness of the web.

11 Claims, 2 Drawing Figures

AIR DECOMPACTION OF PAPER WEBS

BACKGROUND OF THE INVENTION

This invention relates to a method and apparatus for reducing the density and increasing the bulk of a formed fibrous web, and more particularly to directing a gaseous medium, such as air, onto the surface of a fibrous web so as to decompact the fibrous web throughout the entire thickness of the web.

One well known prior art approach for obtaining a uniform, low density, high bulk fibrous web is to dry form the web from a gaseous suspension such as air. Such webs are formed by conveying the fibers in an air stream and depositing them in a randomly arranged and intermingled fashion on a foraminous surface in the form of a fibrous web or batt. The speed of web formation in air is slow when compared to the speed of papermaking machines that form a web from a water suspension at a rate in excess of 4,000 feet per minute. It would, therefore, be highly desirable to be able to modify the structure of a web formed web either at an off line station or at some point in a conventional papermaking process in order to achieve the low density, high bulk characteristics normally attributed to a web made by an air forming process.

U.S. Pat. No. 3,490,103-Asaka, et al. discloses that the structure of a pre-formed pulp sheet can be modified so that both surfaces are highly decompacted while, as indicated in FIG. 3, the central core region remains relatively dense. In Asaka, et al., as mentioned at column 1, lines 25 and 36 and again at column 2, line 12 a moistened pulp sheet is placed in tight engagement between a pair of wire mesh screens and then air is directed under pressure against the surface of the sheet in order to decompact the fibers in the surface of the sheet.

U.S. Pat. No. 3,556,931-Champaigne is concerned with modifying the structure of a wet formed pulp board sheet by decompacting both surfaces of the sheet without substantially affecting the density of the central region of the pulp board sheet. Champaigne accomplishes this by treating the surfaces of the pulp board sheet with a debonding agent to weaken the bonds between fibers in the surfaces and then mechanically working, or flexing, the sheet to further break bonds in the surfaces of the sheet, then, as stated at column 2, line 14 tightly sandwiching the pulp board sheet between foraminous members, and directing air blasts at the surface of the sheet to fluff the relatively unbonded fibers.

Another disadvantage of the prior decompaction art, as represented by Asaka et al. and Champaigne, is that those patents require the fibrous sheets to be moistened before the surfaces can be decompacted. It has been found that when the initial web has been treated or formed to have a basis weight in the range of 20 to 60 pounds per ream and a breaking length of between 50 to 500 meters, the web need not be premoistened in order to achieve substantial decompaction throughout the entire thickness of the web.

In describing the invention, it is convenient to use the parameter, non-directional breaking length, to indicate the initial strength of the interfiber bonds within the web. As is well known in the papermaking art, the breaking length of a web is the length of a strip of the web required to cause the strip to break under its own weight. Furthermore, since it is quite common for the breaking length of a strip of a web that runs in the machine direction to differ from the breaking length of a strip of the web that runs along the cross machine direction, for the purposes of this application, the term non-directional breaking length is defined to be the square root of the product of the machine direction and cross machine direction breaking lengths.

It is therefore, one object of this invention to provide an improved method and apparatus for producing a low density, high bulk fibrous web.

It is another object of this invention to substantially reduce the density and increase the bulk of a web formed fibrous web, having certain prescribed characteristics.

Another object of this invention is to substantially reduce the density and increase the bulk of a wet formed fibrous web throughout all regions of the web.

And yet another object of this invention is to treat a wet formed fibrous web so that it will have the density and bulk characteristics of an air-formed fibrous web.

SUMMARY OF THE INVENTION

It has been found that fibrous webs, and preferably those that are wet formed, having certain specific characteristics, can be successfully decompacted throughout all regions of the web in order to provide a structure having the density and bulk characteristics of an air formed web. In particular, lighter weight fibrous webs, having a basis weight in the range of about 20 pounds per ream to about 60 pounds per ream and which have a breaking length in the range of 50 to 500 meters can be successfully decompacted throughout all regions of the web by impinging a gaseous medium, such as air under pressure, onto both surfaces of the web.

In accordance with this invention, a web having a basis weight that ranges between 20 to 60 pounds per ream and having a non-directional breaking length that ranges between 50 and 500 meters is loosely placed between a pair of wire screens. The screens and the web are then transported past a nozzle assembly that impinges a gaseous medium onto the surface of the web with sufficient velocity so that the fibrous web is decompacted throughout the entire thickness of the web. In one embodiment of this process, both surfaces of the web are simultaneously decompacted by air jets and the air jet assemblies are either offset or the air jet orifices are so located that the main jet stream directed at one surface of the web does not substantially overlap with the corresponding main jet stream directed at the other surface of the web. The impingement velocity of the gas is such that the gas will penetrate through the central regions of the web so as to substantially decompact the interior of the web. After the web has been decompacted, bonding material can be applied to the web in order to give structural rigidity to the resulting sheet.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 1:
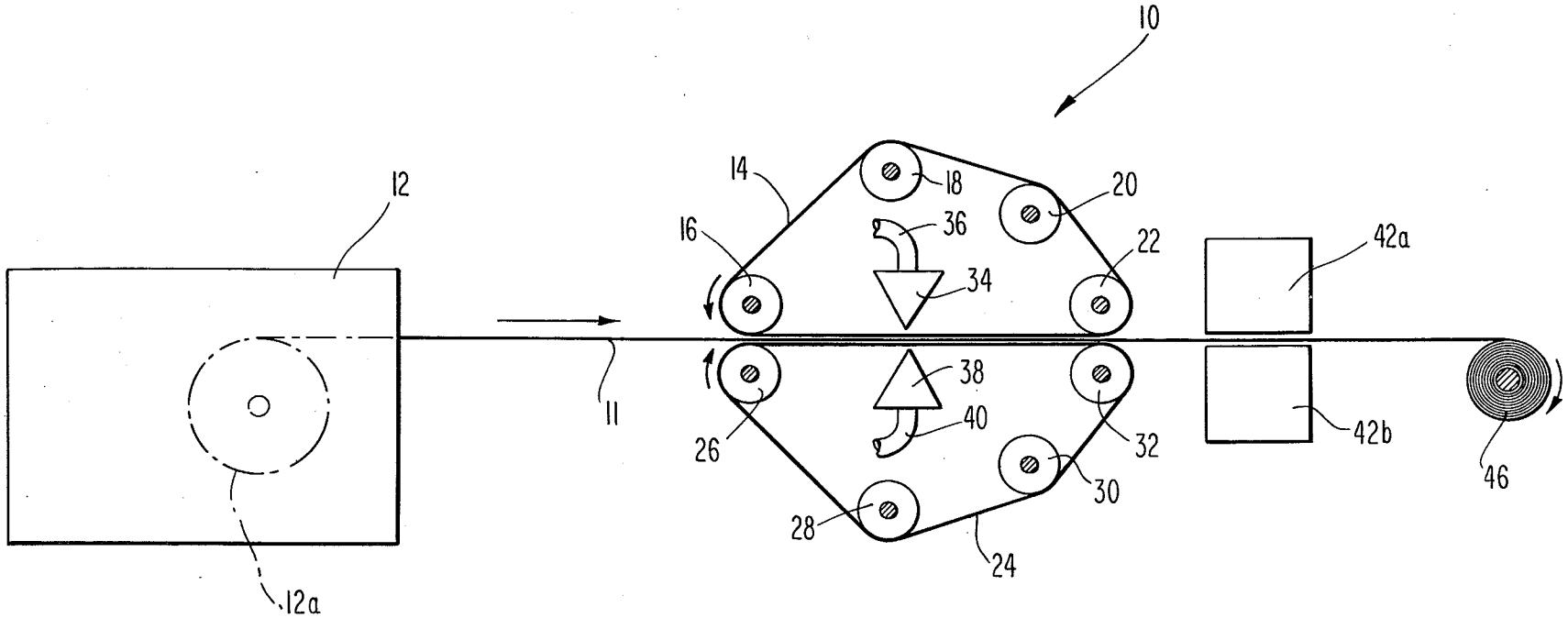
FIG. 1 is a schematic representation in side elevation of one form of apparatus for uniformly decompacting a fibrous web by the method of the present invention.

In accordance with my invention the initial web that is to be decompacted has a basis weight in the range of 20 to 60 pounds per ream of 2880 square feet and the web fibers are weakly bonded as measured by the non-directional breaking length which is between 50 and 500 meters. Normally, fibrous webs in which the fibers are bonded together entirely by natural fiber bonds and which are made by conventional papermaking processes in which no attempt is made to disrupt or retard natural fiber bonding, will not have the requisite basis weight and breaking length requirement to be substantially decompacted throughout the entire thickness of the web by the method described herein. It is well known in the art that the breaking length of such webs can be reduced by treating the formed web with a chemical debonder that will weaken or disrupt natural fiber bonds. It is further known that mechanical working of the sheet also disrupts and weakens natural fiber bonds. Because it is difficult to control the uniformity of debonding when a formed sheet is mechanically treated or treated with a chemical debonder, it is preferred to practice the invention on a sheet that, as initially formed, has the required basis weight and breaking length characteristics. Such a uniformly debonded sheet can be obtained by forming the sheet from an aqueous slurry consisting of normal, untreated papermaking fibers mixed with modified cellulosic fibers. The untreated fibers are lignocellulosic fibers like wood pulp or cotton linters used in papermaking, which are short fibers normally having a length of less than one-fourth inch. The modified fibers are wood pulp fibers that have been treated as disclosed in U.S. Pat. No. 3,819,470 issued to D. L. Shaw and E. A. Wodka, and assigned to the assignee of this invention. The Shaw-Wodka patent discloses that modified cellulosic fibers can be obtained by treating an aqueous slurry of the fibers with a substantive polymeric compound, drying the treated fibers to cause the polymeric compound to react with itself and with the fibers, and then refiberizing in water to separate the individual treated fibers. Cellulosic sheet materials prepared from a furnish comprising these treated fibers, either alone or in combination with normal untreated papermaking fibers, have increased bulk and reduced tensile strength when compared to cellulosic sheets made entirely from untreated papermaking fibers. For a given basis weight, the ratio of modified fibers to untreated fibers in the furnish can be varied to provide a web with a breaking length within the desired range to practice this invention.

Fibrous webs having the desired range of basis weight and breaking length can also be manufactured by a papermaking process in which wet pressing is reduced or eliminated as disclosed in U.S. Pat. No. 3,821,068, issued to D. L. Shaw and assigned to the assignee of this invention, if a debonder such as Quaker 2006 manufactured by Quaker Chemical Company is added to the furnish.

Referring now to FIG. 1 there is shown a decompacting unit 10 that is increasing the bulk of a fibrous web 11 that is being formed by a papermaking machine 12. The papermaking machine 12 can be a conventional papermaking machine, that is, one that employs mechanical compression or squeezing of the web during drying, or can be a papermaking machine as described in the aforementioned Shaw Patent. In either case, the decompacting unit 10 would be located just before, or just after, the final drying stage of the papermaking machine 12. In an alternate embodiment the source of the web 11 could be a parent roll **12*a* of the web material which has the required basis weight and breaking length characteristics. The web 11 is fed from the parent roll 12*a* which is unwound by conventional drive means (not shown). The web 11 is then transported through the decompacting unit 10. After the entire thickness of the web has been decompacted, the web is transported to a rebonding station 42 where bonding material is applied to the decompacted web in order to provide it with increased structural rigidity. After the web has been rebonded, the web is accumulated for example, by winding it into a parent roll 46**.

In the preferred embodiment of the invention both surfaces of the web are simultaneously decompacted. Thus, there is shown in FIG. 1 a first endless screen 14 which is caused to travel adjacent to the upper surface of the web 11 in a path defined by a plurality of guide rolls 16, 18, 20 and 22, at least one of which is driven by conventional drive means (not shown). In a similar manner, a second endless wire screen 24 is made to travel adjacent the lower surface of web 11 in a path defined by a plurality of guide rolls 26, 28, 30 and 32, at least one of which is driven by conventional drive means (not shown). The guide rolls are positioned so that the wire screens 14 and 24 will describe a path a portion of which is parallel to each other and to the surfaces of the web 11. The location of the axis of at least one guide roll of each set should be adjustable in order to control the tension of wire screens 14 and 24 in order to make sure that the wire screens maintain the desired separation while the web is being decompacted. Located within the wire screen 14 is a gas nozzle assembly 34. A gaseous inlet port 36 conducts a gaseous medium, such as air under pressure, from a source (not shown) to the nozzle assembly 34. In a similar manner, there is shown located within the endless wire screen 24 a gas nozzle assembly 38 to which the gaseous medium is conducted from the source by means of inlet port 40. The pressure of the gaseous medium is such that the gas exits from the nozzle assemblies 34 and 38 at sonic velocity. The gas penetrates through the central region of the web and disrupts the bonds that hold the web together so that when the web leaves the decompacting area, in the vicinity of air nozzles 34 and 38, the web has been substantially decompacted throughout the entire thickness of the web.

Upon leaving the decompaction unit 10, the web is transported to a rebonding station represented by blocks **42*a* and 42*b* where a bonding material is applied to the decompacted web and allowed to set which provides the decompacted web with increased structural rigidity prior to being wound onto parent roll 46**. The rebonding step is well known in the art and is commonly used to provide structural rigidity to air formed webs.

Figure 2:
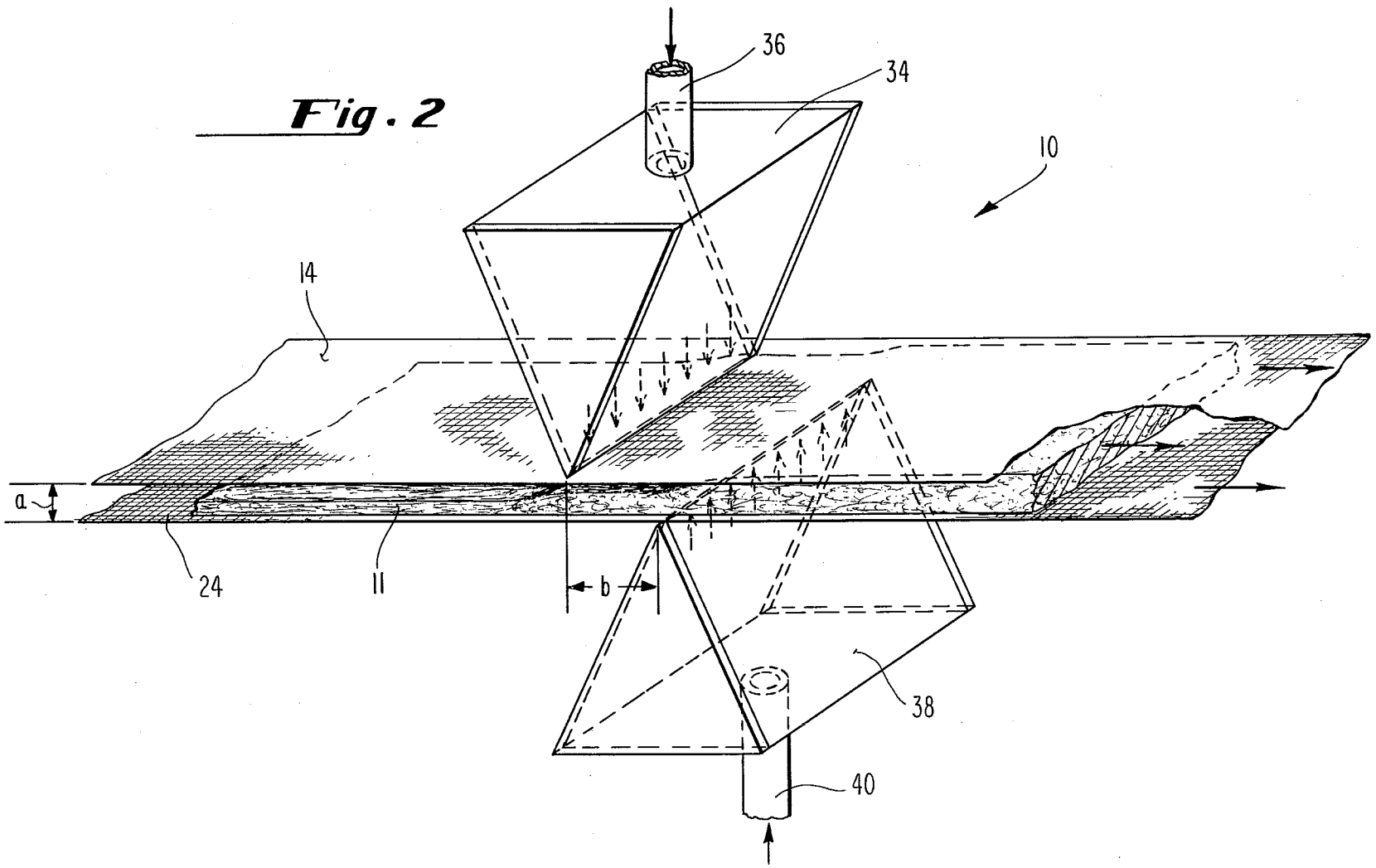
FIG. 2 is an enlarged isometric schematic representation of the decompaction area of the apparatus.

FIG. 2 is an enlarged view of the decompacting apparatus 10 in the area where the decompaction takes place. As shown in FIG. 2, the endless wire screen 14 is spaced a distance, *a*, from endless wire 24. This distance, *a*, for the most part determines the thickness of the decompacted web. It is preferred that the separation, *a*, between screens 14 and 24 be between 2 and 8 times the initial thickness of the web 11. This is in contrast to the teaching of the patents of Champaigne and Asaka et al.

wherein the screens are maintained in tight contact with the initial surface of the web, and, therefore, have a spacing that is about the same or even less than the initial thickness of the web.

The mesh size of endless screen 14 and 24 also has an effect on the quality of decompaction of the web. The mesh size openings should be related to the average length of the fibers in the web. If the mesh openings are much greater than the length of the fibers, the decompaction process will blow holes in the web with the result that the web will no longer have a continuous structure. If the percent open area of the wire screen is small, the screen itself will provide a large resistance to the decompacting gas which prevents complete decompaction through the entire thickness of the web or results in a very inefficient decompaction process. Typically screens having a mesh in the range of 10 to 30 have been used to successfully decompact a web that consists of lignocellulosic fibers. In one embodiment, the decompaction apparatus used a stainless steel square mesh screen with a mesh size of 30 and a wire diameter of 0.010 inches.

The nozzle assemblies 34, 38 should be located very close to the screens 14 and 24 so that the gas impinges on the surface of the web with a relatively high velocity. The exit orifices of nozzle assemblies 34 and 38 should be located or oriented so that gas that is directed out of the orifice of nozzle assembly 34 is not in direct opposition to gas directed from a corresponding orifice in nozzle assembly 38. Thus, if as in FIG. 2, each nozzle assembly 34, 38 has a single rectangular orifice that is 0.020 inches wide, it is highly desirable to offset nozzle assembly 38 in the direction of travel of the web 11 by a short distance indicated as *b*. If the two nozzle assemblies 34, 38 are in direct alignment then the gas being expelled from nozzle assembly 34 and the gas being expelled from nozzle assembly 38 would directly oppose each other and therefore, would not penetrate through the central regions of the web 11, and would actually represent a compactive force on the central regions of the web. By displacing nozzle assembly 38 a distance, *b*, from nozzle assembly 34, the gas expelled through the orifice of nozzle assemblies 34, 38 can penetrate through the central region of the web 11. The distance, *b*, is typically in a range of 0.10 to 0.50 inches.

The decompaction time depends on a number of variables including the initial basis weight and breaking length of the web, the impingement velocity of the air on the sheet and the length of time that the sheet is exposed to the decompacting gas. Typically, the amount and velocity of the air as it is expelled from the orifice of air nozzles 34 and 38 is determined by controlling the pressure of the air source. The length of time that the web is exposed to the impinging air can be varied by repeatedly passing the web by the air decompacting apparatus. If two webs have the same breaking length and different basis weights, the higher basis weight web will require a longer exposure time to substantially decompact the entire thickness of the web. This is believed to be due primarily to the increased number of fibers in the path of the gaseous medium. By substantially decompacted throughout the entire thickness of the web, it is meant that no region of the decompacted web appears to have maintained its original density that if the web is arbitrarily divided into a number of regions, each region will be decompacted by about a factor of 2.5. When water formed sheets are uniformly decompacted substantially throughout the entire thickness of the sheet in accordance with the invention, the decompacted sheet has the appearance and feel of an air formed sheet. The decompacting process of this invention has been used to increase the thickness of a fibrous web from 2 to 8 times the original thickness with all regions of the web being substantially decompacted.

Table I shows the variation of the air pressure of the source and the number of passes of the web past the decompacting unit for five different example webs.

The web of Example 1 was prepared from a furnish consisting of 40% modified Southern pine kraft dry lap fibers and 60% untreated Southern pine kraft dry lap fibers. The modified fibers were made in accordance with the aforementioned Shaw-Wodka patent by adding to the pine fibers a substantive polymeric compound in the amount of 6 percent of the bone dry weight of the fibers and 1% Velvetol HS manufactured by Quaker Chemical Company. 2.1 grams of the total furnish was mixed with 500 milliliters of water for 8 seconds in a Waring blender. A hand sheet was made on a Noble and Wood papermaking apparatus. The hand sheet was formed in the deckle box on a 100 mesh screen then wet pressed until the sheet was approximately 33% dry. The sheet was then passed over a drum dryer, heated to 180° F., until the sheet was approximately 95% dry.

The sheet of Example 2 was prepared in the same manner as the sheet of Example 1 except that the furnish consisted of 60% modified Southern pine kraft dry lap fibers and 40% untreated Southern pine kraft dry lap fibers.

The sheet of Example 3 was made in the same manner as the sheet of Example 1 except that the furnish consisted of 70% modified Southern pine kraft dry lap fibers and 30% untreated Southern pine kraft dry lap fibers.

In making the sheet of Example 4 the process utilized for Example 1 was modified by adding 1% Velvetol HS manufactured by Quaker Chemical Company to the furnish and by eliminating the wet pressing steps.

The sheet of Example 5 was made using the same procedure as for the sheet of Example 1 except that the furnish consisted of 60% pressure refined spruce pulp-Bauer 4910 and 40% untreated Southern pine kraft dry lap fibers.

The five sample sheets were decompacted with the apparatus as described and shown in FIGS. 1 and 2 wherein screens 14 and 24 were made with wire having a diameter of 0.010 inches and which had 30 meshes per inch; the spacing, *a*, between the screens was 0.021 inches (0.028 for Example 3); the offset distance, *b*, between the two air knives was 0.312 inches; the exit orifices of nozzle assemblies 34 and 38 were each 9 inches long and 0.020 inches wide. The web was transported past the nozzle assemblies at a speed of 700 ft/min.

Table I shows the initial basis weight and initial breaking length of the five example sheets and also shows the pressure of the air source and the number of passes by the nozzle assemblies in order to substantially decompact each sample throughout the entire thickness of the sheet.

TABLE I

| Example | Basis Weight lb/ream | Breaking Length meters | Pressure psig | Passes |
|---|---|---|---|---|
| 1 | 30 | 231 | 22 | 2 |
| 2 | 30 | 165 | 22 | 2 |
| 3 | 60 | 110 | 20 | 4 |
| 4 | 30 | 281 | 28 | 2 |

TABLE I-continued

| Example | Basis Weight lb/ream | Breaking Length meters | Pressure psig | Passes |
|---|---|---|---|---|
| 5 | 30 | 145 | 25 | 3 |

Each of the five example sheets was substantially decompacted through the entire thickness of the web and has the appearance and feel of a web made by the air forming process.

Although the examples of Table I were decompacted by passing the web past the gas nozzle assemblies a number of times, it will be apparent to those skilled in the art that a plurality of gas nozzle assemblies can be located within the traveling screen assemblies, or alternatively, the gas nozzle assembly can be designed with a plurality of orifices so as to increase the amount of gas that is impinged on the surface of the web. In this manner, it is expected that webs can be decompacted at speeds greatly in excess of 700 feet per minute.

The prior patents to Champaigne and Asaka et al. disclose that the initial sheet should be moistened prior to decompacting the surfaces of the sheet. It has been found that essentially dry sheets, that is, sheets containing less than 9% moisture, and having a basis weight in the range of 20 to 60 pounds per ream and a non-directional breaking length in the range of 50 to 500 meters, can be substantially decompacted throughout the thickness of the web. This means that the moistening step can be eliminated from the process.

While the present invention has been described with reference to a specific embodiment thereof, it will be obvious to those skilled in the art that various changes and modifications may be made without departing from the invention in its broadest aspects. It is contemplated in the appended claims to cover all variations and modifications of the invention which come within the true spirit and scope of the invention.

What is claimed as new and desired to be secured by Letters Patent of the United States is:

1. A method of forming a high bulk, low density fibrous web comprising the steps of:
   (a) forming a fibrous web having a basis weight of about 20 to about 60 pounds per ream and a non-directional breaking length of about 50 to abut 500 meters;
   (b) transporting the web between a pair of foraminous restraining members spaced apart at least two times the initial thickness of the web; and
   (c) impinging a gaseous medium through the foraminous restraining members onto opposed major surfaces of the web for decompacting the web substantially throughout the entire thickness of the web by a factor of about 2.5.

2. A method of forming a web as recited in claim 1 further comprising the step of applying a bonding material to the decompacted web in order to provide increased structural rigidity to the decompacted web.

3. A method of forming a high bulk, low density fibrous web comprising the steps of:
   (a) forming from an aqueous slurry a substantially uniformly debonded fibrous web of cellulosic fibers having a predominant length of less than one-fourth inch and having a basis weight of about 20 to about 60 pounds per ream and a non-directional breaking length of about 50 to about 500 meters;
   (b) transporting the web between a pair of foraminous restraining members spaced apart at least two times the initial thickness of the web; and
   (c) impinging a gaseous medium through the foraminous restraining members onto opposed major surfaces of the web for decompacting the web substantially throughout the entire thickness thereof and for decreasing the density throughout all regions of the web by a factor of about 2.5.

4. A method of forming a web as recited in claim 3 further comprising the step of applying a bonding material to the decompacted web in order to provide structural rigidity to the decompacted web.

5. A method as recited in claim 3 wherein the formed fibrous web has a basis weight of about 30 to about 60 pounds per ream.

6. A method as recited in claim 3 wherein the formed fibrous web has a basis weight of about 30 to about 60 pounds per ream and a non-directional breaking length of about 110 to 270 meters.

7. A method of forming a high bulk, low density fibrous web comprising the steps of:
   (a) forming from an aqueous slurry a substantially uniformly debonded fibrous web of cellulosic fibers having a predominant length of less than one-fourth inch and having a basis weight of about 20 to about 60 pounds per ream and a non-directional breaking length of about 50 to about 500 meters and containing less than 9 percent moisture;
   (b) transporting the web between a pair of foraminous restraining members spaced apart at least two times the initial thickness of the web; and
   (c) impinging a gaseous medium through the foraminous restraining members onto opposed major surfaces of the web for decompacting the web substantially throughout the entire thickness thereof and for decreasing the density throughout all regions of the web by a factor of about 2.5.

8. A method of decompacting a substantially uniformly debonded fibrous web of cellulosic fibers having a predominant length of less than one-fourth inch and having a basis weight of about 20 to about 60 pounds per ream and a nondirectional breaking length of about 50 to about 500 meters, comprising the steps of:
   (a) transporting the web between a pair of spaced-apart foraminous restraining members, the spacing between the restraining members being at least two times the initial thickness of the web; and
   (b) impinging a gaseous medium through the foraminous restraining members onto the surface of the web, said gas substantially decompacting the entire thickness of the web by decreasing the density throughout all regions of the web by a factor of about 2.5.

9. A method as recited in claim 8 further comprising the step of rebonding the web to provide increased structural rigidity to the decompacted web.

10. A method of decompacting a substantially uniformly debonded fibrous web of cellulosic fibers having a predominant length of less than one-fourth inch and having a basis weight of about 20 to about 60 pounds per ream and a nondirectional breaking length of about 50 to about 500 meters, comprising the steps of:
   (a) transporting the web between a pair of spaced-apart foraminous restraining members said spacing between the restraining members being at least two times the initial thickness of the web;

(b) then transporting the web past opposed and offset gas impingement means; and (c) impinging a gaseous medium simultaneously through both foraminous restraining members and onto both surfaces of the web, said gaseous medium substantially decompacting the entire thickness of the web, by decreasing the density throughout all regions of the web by a factor of about 2.5.

11. A method as recited in claim 10 further comprising the step of rebonding the web to provide structural rigidity to the decompacted web.

* * * * *